United States Patent [19]

Manning

[11] 4,020,379

[45] Apr. 26, 1977

[54] BULB-SHAPED FLASHTUBE WITH METAL ENVELOPE

[75] Inventor: William L. Manning, Walpole, Mass.

[73] Assignee: EG&G, Inc., Wellesley, Mass.

[22] Filed: Oct. 2, 1975

[21] Appl. No.: 618,852

[52] U.S. Cl. ..... 313/220; 313/281; 313/313

[51] Int. Cl.[2] ..... E05C 7/06

[58] Field of Search ..... 313/220, 281, 313, 44, 313/46, 221

[56] References Cited

UNITED STATES PATENTS

| | | | |
|---|---|---|---|
| 1,988,933 | 1/1935 | Asakawa | 313/220 X |
| 2,013,095 | 9/1935 | Friend | 313/313 |
| 2,499,489 | 3/1950 | Goldstein et al. | 313/313 X |
| 2,542,440 | 2/1951 | Victoreen et al. | 313/281 X |
| 2,686,269 | 8/1954 | Levitt et al. | 313/313 X |
| 3,027,482 | 3/1962 | Gallup | 313/313 |

FOREIGN PATENTS OR APPLICATIONS

| | | | |
|---|---|---|---|
| 148,375 | 9/1952 | Australia | 313/313 |

*Primary Examiner*—Stanley T. Krawczewicz
*Attorney, Agent, or Firm*—Ralph L. Cadwallader; Leo M. Kelly

[57] ABSTRACT

A bulb-shaped flashtube is provided with a metal envelope to increase its strength and enhance its reliability and operating characteristics. The metal envelope comprises a hollow cylindrical container including an open bottom end and an inwardly extending annular flange at its top end which defines a window opening in the container. A circular base of insulating material is sealed in the open bottom end of the container. A plurality of conductors extend through the insulating base to support a plurality of electrodes within the container. A circular, transparent window is sealed to the annular flange inside the top end of the container for transmitting a flash of light upon electrical discharge between the electrodes.

20 Claims, 11 Drawing Figures

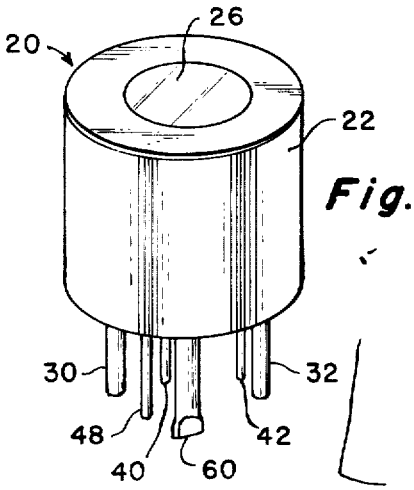
Fig. 1
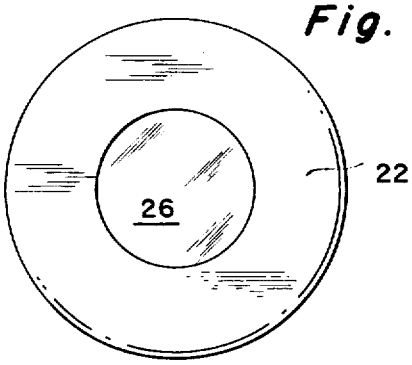
Fig. 6
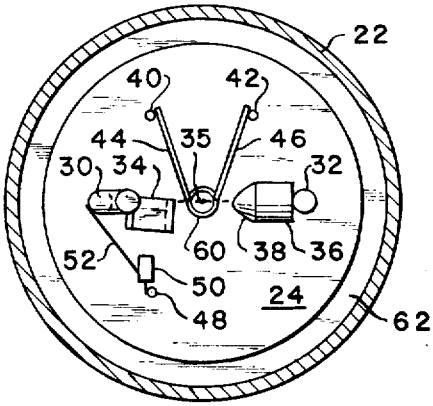
Fig. 3
Fig. 4
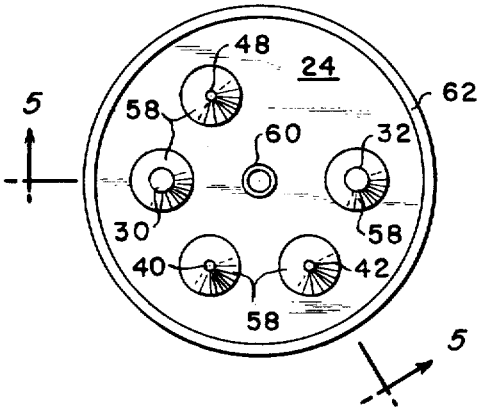
Fig. 5
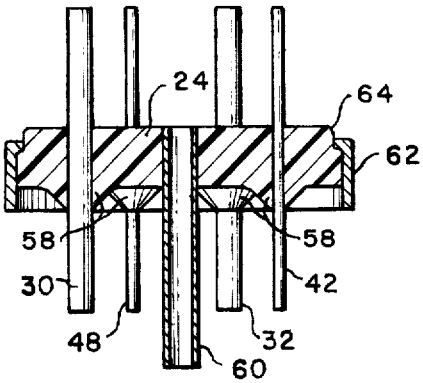
Fig. 2
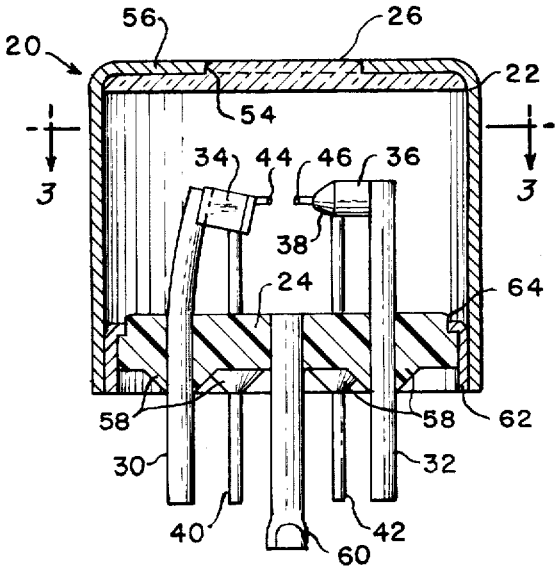

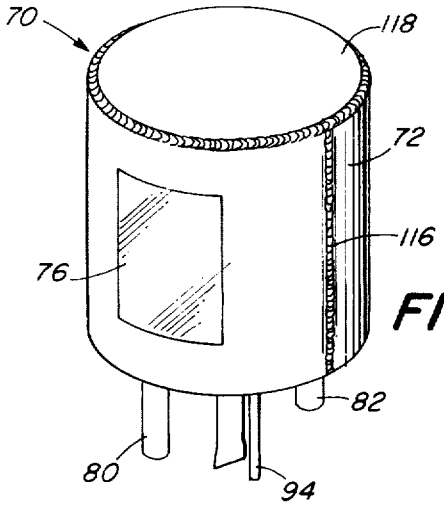
FIG. 7
FIG. 9
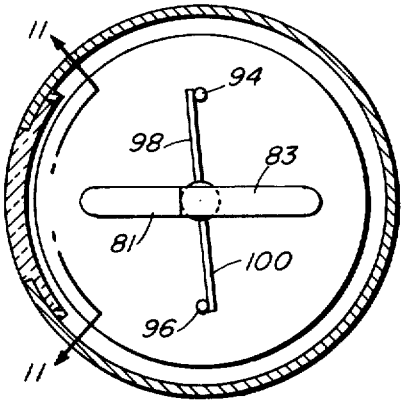
FIG. 11
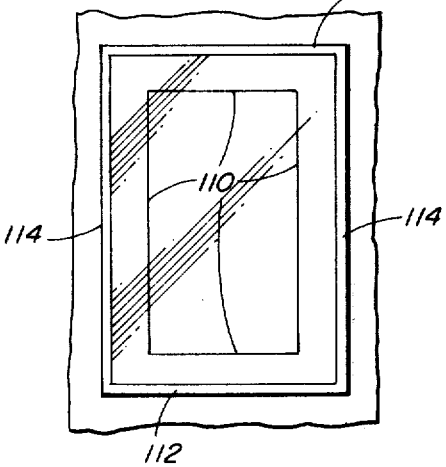
FIG. 8
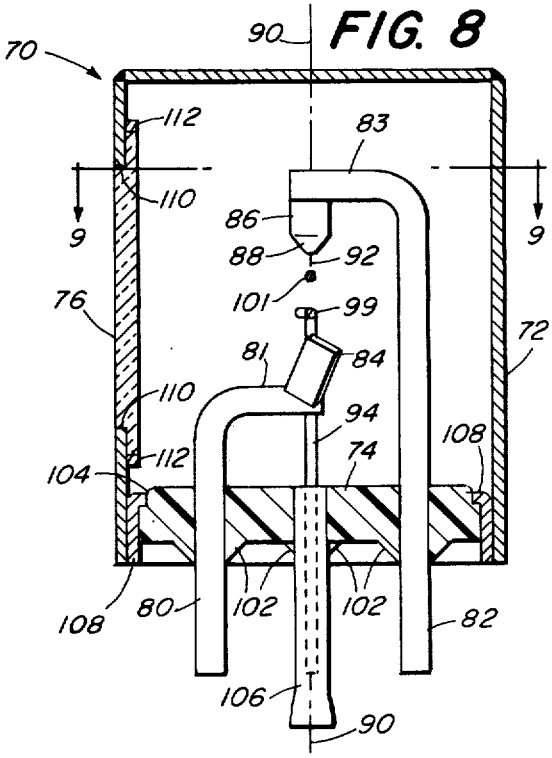
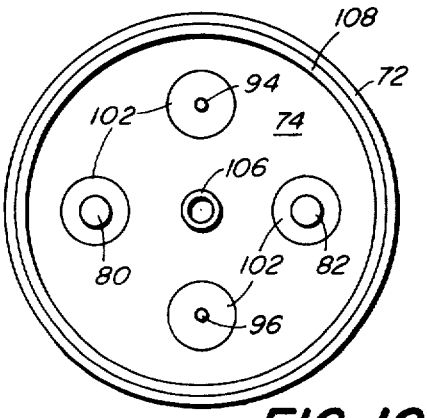
FIG. 10

BULB-SHAPED FLASHTUBE WITH METAL ENVELOPE

The present invention relates to gaseous-discharge devices and, more particularly, to a bulb-shaped flashtube provided with a metal envelope to increase its strength and enhance its operating characteristics.

Generally, a flashtube is a type of gaseous-discharge device comprising a gas-filled envelope which confines spaced anode and cathode electrodes in a gaseous medium. A flash-producing arc is generated upon electrical discharge between the electrodes through the gaseous medium. Trigger electrodes can be provided in the flashtube to facilitate breakdown of the gaseous medium to achieve the electrical discharge. The flashtube can be operated to produce a single flash or a repetition of light flashes. It is particularly useful in flash photography, stroboscopic work and photo-typesetting devices.

Generally, two types of flashtubes in current use are the bulb-shaped flashtube and the linear flashtube. In the bulb-shaped flashtube, such as described in U.S. Pat. No. 2,977,508 assigned to the same assignee as the present invention, the leads to the main and trigger electrodes pass through a base that is sealed to a bulb-shaped glass envelope. In the linear flashtube the length of the envelope may be greater than six times its diameter and the main electrodes pass through seals at each end of the envelope. In some types of linear flashtubes a trigger wire is wound around the outer diameter of the flashtube between the electrodes. The present invention relates primarily to bulb-shaped flashtubes.

It has been customary to fabricate the bulb-shaped flashtube envelope entirely of transparent glass which transmits the flash of light produced by electrical discharge between the main electrodes. The use of glass for the entire envelope has necessitated steps in previous fabrication techniques to ensure accurate alignment of the electrodes within the envelope. In addition, it has been necessary to employ special glass-to-metal seals to seal the base through which the electrodes pass to the glass envelope. The prior art bulb-shaped flashtubes have also been susceptible to inaccurate alignment of the electrodes by virtue of movement of the conductors and electrodes in the course of fabrication.

The bulb-shaped flashtubes of the prior art including envelopes composed entirely of glass have been characterized by generally poor heat dissipation. The glass envelope, by virtue of its heat insulating characteristics, has allowed heat to accumulate to raise the temperature within the flashtube. The rise in temperature has been accompanied by a corresponding increase in pressure of the gaseous medium in the flashtube. The increased pressure results in high stresses on the glass envelope and on the glass-to-metal seals for the base and the conductors in the base. Accordingly, it has been necessary to limit the initial, static pressure in the prior art bulb-shaped flashtubes to avoid cracking under the high stresses caused by the increase in temperature and pressure in the operation of such flashtubes Typically, glass bulb-shaped flashtubes have been filled with gas, e.g., xenon, or a gaseous mixture, e.g., xenon, argon, and nitrogen, to a maximum static pressure of about two atmospheres. Because glass has limited resistance to stress, particularly at elevated temperatures, these flashtubes have been limited to a maximum operating pressure of about two and one-half atmospheres or three atmospheres. Further, the glass envelopes of the prior art have been susceptible to cracking as a result of the abrupt temperature changes generated by electrical discharge between the electrodes.

In addition, since the glass bulb-shaped flashtubes exhibit poor heat dissipation qualities and limited resistance to stresses at high temperature, these prior art flashtubes have been restricted to operation at relatively low power levels. Typically, such flashtubes have been limited to a maximum input power of approximately 15 watts. However, in view of the usual safety factor (e.g., a safety factor of five) applied to such devices, the flashtubes have been practically limited to power inputs of only a few watts.

Further, in the operation of the prior art bulb-shaped flashtubes with envelopes composed entirely of glass there has been a tendency for electrical charges to accumulate on the interior wall of the glass envelope. The accumulated charges have resulted in spurious electric fields which produce undesirable electrical discharges and interfere with the desired operation of the flashtubes. More specifically, the spurious electric fields have increased the trigger and supply voltages required to reliably operate the prior art flashtubes of the bulb-shaped glass envelope type. Also, in some applications, such prior art flashtubes have been used with separate electrical shields to reduce the effective radio frequency interference (RFI) signals produced by the flashtubes during operation.

To eliminate the above disadvantages of the prior art, the present invention contemplates a bulb-shaped flashtube in which the envelope is partially composed of metal with a transparent window to increase the strength of the envelope and to enhance the reliability and operating characteristics of the flashtube. It is an objective of the invention to provide a bulb-shaped flashtube which can be filled with a gaseous medium at a higher pressure than previously possible in the prior art. Another purpose is to achieve a bulb-shaped flashtube which can be readily fabricated with accurate alignment of its electrodes. A further objective is to provide a flashtube envelope which can be grounded to achieve more reliable operation at lower voltages than possible with prior art devices and to eliminate the necessity of a separate electrical shield for RFI. An additional objective is to provide a bulb-shaped flashtube envelope which readily dissipates heat to cool the flashtube during assembly to avoid misalignment of the electrodes and during operation to reduce the operating temperature and pressure to permit the flashtube to operate at substantially higher power levels.

In accordance with the invention, an improved envelope structure for a gaseous discharge device of the type comprising a gas-filled envelope which contains spaced electrodes for electrical discharge therebetween to produce a flash of light comprises a hollow conductive body having first and second openings, an insulating base sealed in the first opening of the conductive body for supporting the electrodes within the conductive body, and a transparent window sealed to the inside of the conductive body over the second opening for transmitting the flash of light therethrough upon electrical discharge between the electrodes. Preferably, the hollow conductive body is cylindrical in shape and includes a first open end in which the insulating base is sealed and a second partially closed end provided with a window opening. The transparent window is sealed to the interior of the body at its partially closed end over the window opening.

In a preferred embodiment of the invention, the envelope comprises a hollow cylindrical container of metallic material provided with an open bottom end and an inwardly extending annular flange at its top end which defines a window opening in the container, a circular glass base sealed in the open bottom end of the container for supporting the electrodes within the container, and a circular, transparent glass window sealed to the annular flange inside the top end of the container for transmitting the flash of light therethrough upon electrical discharge between the electrodes. A ring of metallic material interposed between the hollow cylindrical container and the circular glass base is welded to the container and sealed to the base. A plurality of conductors extend through the circular glass base for supporting spaced anode and cathode electrodes within the container and probe-type trigger electrodes in the discharge path between the anode and cathode electrodes. An additional conductor may extend through the base to support a sparker assembly, if its use is desired, adjacent to the cathode. In addition, a tubulation extends through the circular glass base to provide an outlet for exhausting impurities from the interior of the envelope and an inlet for supplying a gaseous medium to the interior of the envelope. The tubulation is sealed after the envelope is filled with the gaseous medium.

In an alternative embodiment of the invention, the envelope comprises a hollow cylindrical container of metallic material provided with an open bottom end and a closed top end with a window opening formed in the side of the container, a circular glass base sealed in the open bottom end of the container for supporting the electrodes within the container, and a transparent glass window sealed to the inside of the container over the side window opening. A plurality of ribs may be formed on the inside of the container surrounding the window opening with the transparent window extending along the inside of the container to the ribs. Preferably, the window opening is substantially rectangular in configuration with the ribs arranged in a rectangular configuration about the opening and the transparent window is a substantially rectangular glass window with its edges exteding outwardly to the ribs.

The present invention achieves a bulb-shaped metal envelope flashtube which is increased in strength in comparison with prior art devices. The increased strength of the envelope allows the flashtube to be filled with more gas at higher density and pressure than possible in the prior art. The increased density of the gas under higher pressure permits a larger flashing-producing arc to occur upon an electrical discharge to generate a more intense flash of light.

In addition, the provision of a metal envelope permits the envelope to be grounded with the result that lower trigger and supply voltages can be used to operate the flashtube in comparison with prior art flashtubes of the glass, bulb-shaped envelope type. The grounded metal envelope eliminates the possibility of accumulation of electrical charges on the envelope to avoid the undesirable electrical discharges associated with spurious electric fields in the prior art flashtubes and to allow more reliable operation at lower voltages. The grounded envelope also provides an electrical shield around the flashtube which reduces the effect of radio frequency interference (RFI) produced during its operation. This feature is particularly advantageous in use of the flashtube in phototypesetting equipment where integrated circuits (IC) and transistor-transistor logic circuits (TTL) must be shielded from RFI to avoid error in their operation.

Further, the metal envelope bulb-shaped flashtube can be coupled to a heat sink to dissipate heat at a faster rate than the prior art devices. As a result, the flashtube can be operated at higher peak powers than the glass bulb-shaped type flashtubes. The annular metal flange around the window of the flashtube allows heat to be readily conducted away from the glass window to prevent cracking of the window. The metal envelope has the effect of cooling the gaseous medium in the flashtube. Thus, the temperature and pressure of the gaseous medium remain low in contrast to the situation in a glass bulb-shaped envelope where the envelope accumulates heat. Consequently, the glass window and glass base are not subjected to the high stresses encountered in glass bulb-shaped type flashtubes of the prior art. In addition, the heat dissipating features of the metal envelope reduce the possibility of misalignment of the electrodes in the assembly of the flashtube.

The accompanying drawing illustrates a preferred embodiment of the invention and, together with the description, serves to explain the principles of the invention.

In the drawing:

FIG. 1 is a perspective view of a metal envelope bulb-shaped flashtube constructed according to the principles of the present invention;

FIG. 2 is an enlarged elevation view, partially in section, of the metal envelope flashtube illustrating a cylindrical metallic body, an insulating base, and a transparent window which constitute the flashtube envelope and a plurality of conductors extending through the insulating base which support the flashtube electrodes;

FIG. 3 is a plan view, partially in section, taken along line 3—3 of FIG. 2 illustrating the electrode arrangement of the flashtube;

FIG. 4 is a bottom view of the insulating base and conductors prior to attachment of the electrodes to the conductors;

FIG. 5 is an elevation view, partially in section, of the insulating base and conductors taken along line 5—5 of FIG. 4;

FIG. 6 illustrates the top end of the flashtube of FIG. 1;

FIG. 7 is a perspective view of an alternative embodiment of the metal envelope bulb-shaped flashtube of the present invention;

FIG. 8 is an enlarged elevation view, partially in section, of the metal envelope flashtube of FIG. 7;

FIG. 9 is a plan view, partially in section, taken along line 9—9 of FIG. 8;

FIG. 10 is a bottom view of the flashtube of FIG. 7; and

FIG. 11 is an elevation view taken along line 11—11 of FIG. 9.

Referring to FIGS. 1 and 2, a bulb-shaped flashtube, generally 20, constructed according to the present invention, includes a gas-filled envelope comprising a hollow metallic body 22, an insulating base 24, and a transparent window 26. A plurality of conductors extend through insulating base 24 into the interior of the container and support spaced electrodes for electrical discharge through a gaseous medium confined in the envelope. As shown in FIG. 4, for example, the conductors may be arranged in a configuration suitable to be received in an appropriate electrical socket or female connector (not shown).

FIGS. 2 and 3 illustrate an exemplary embodiment of the configuration and geometry of the electrodes that may be utilized in the flashtube of the present invention, it being understood that other arrangements of electrodes may be utilized therein without departing from the scope of the invention as hereinafter claimed.

As shown in FIGS. 2 and 3, a first pair of rod-like conductors 30 and 32 extend through insulating base 24 at diametrically opposed positions on the base. Conductor 30 may serve as a ground conductor. A rectangular electrode 34, which serves as the cathode of the flashtube, is mounted at the upper end of conductor 30. A generally cylindrical electrode 36 provided with a cone-shaped nose 38, which serves as the anode of the flashtube, is mounted at the upper end of conductor 32. Cathode 34 and anode 36 are located at diametrically opposed positions relative to base 24 to define an electrical discharge path across the center of the base indicated by dashed line 35 (FIG. 3).

In addition, a plurality of conductors extend through the insulating base to support trigger electrodes adjacent to the electrical discharge path between the anode and cathode. For example, as shown in FIGS. 2 and 3, a second pair of rod-like conductors 40 and 42 extend through insulating base 24 at positions adjacent to conductors 30 and 32, respectively. The second pair of conductors 40 and 42 is smaller in diameter than the first pair of conductors 30 and 32. A first probe-type trigger electrode 44 is mounted at the upper end of conductor 40. Its free end extends to a position adjacent to cathode 34 in discharge path 35 between the cathode and anode 36. Similarly, a second probe-type electrode 46 is mounted at the upper end of the conductor 42. Its free end extends to a position adjacent to anode 36 in the discharge path between the anode and cathode 34. If desired, additional conductors and probe-type trigger electrodes can be provided adjacent to the discharge path as illustrated in U.S. Pat. Nos. 2,977,508, 3,350,602 and 3,356,888 assigned to the same assignee as the present invention.

As shown in FIG. 3, an additional conductor 48 may be provided which extends through insulating base 24 adjacent to ground conductor 30. Conductor 48 has substantially the same diameter as conductors 40 and 42. If desired, a sparker assembly 50 is mounted on conductor 48 and is connected by a conductive tab 52 to ground conductor 30. The purpose of the sparker assembly is to reduce the "dark-start" problem as explained in U.S. Pat. Nos. 3,350,602 and 3,356,888 assigned to the same assignee as the present invention.

Referring to FIG. 3, in the exemplary embodiment of the electrodes, anode 36 is welded to the side of conductor 32 with its cylindrical body and nose 38 axially oriented toward the center of the flashtube along a diametric path between conductors 30 and 32. Cathode 34 is welded to the side of ground conductor 30 in an offset position relative to the diametric path between the conductors. The upper end of ground conductor 30 is bent inward toward conductor 32 to tilt the rectangular front face of cathode 34 downward relative to nose 38 of the anode. In addition, cathode 34 is turned at a slight angle on conductor 30 relative to the diametric path between conductors 30 and 32. As a result, one corner of the cathode, i.e., the corner at the intersection of the upper and inner edges of its front face, is oriented in discharge path 35 between the cathode and anode. Preferably, the distance between cathode 34 and probe-type electrode 44 is less than the distance between anode 36 and probe-type electrode 46.

In accordance with the invention, the flashtube envelope generally comprises a hollow conductive body having first and second openings. As shown in FIG. 2, a preferred embodiment of conductive envelope body 22 is embodied as a hollow cylindrical container of metal including an open bottom end and a partially closed upper end provided with a circular window opening 54. Preferably, the top end of cylindrical metallic container 22 is provided with an inwardly extending annular flange 56 which defines the circular window opening.

Insulating base 24 (FIGS. 2 and 4) is generally circular in configuration and preferably composed of glass. The base is provided with a plurality of openings of suitable size for receiving conductors 30, 32, 40, 42 and 48. The openings are preferably arranged in a circular configuration and spaced apart by approximately 60°.

As shown in FIGS. 4 and 5, base 24 includes a plurality of glass beads 58, i.e., cone-shaped areas of glass, on its bottom surface around each conductor opening. The conductors are sealed in the corresponding openings preferably by conventional matched glass-to-metal seals. A peripheral notch 64 is formed in the top surface of the base to define an upper portion of slightly reduced diameter.

Insulating base 24 is also provided with a central opening for receiving a tubulation 60. The tubulation is composed of metal and sealed to the glass base by conventional metal-glass sealing techniques. The purpose of the tubulation is to provide an outlet for removing impurities from the interior of the flashtube after assembly of the envelope and an inlet for supplying the desired gaseous medium to the flashtube. The lower end of tubulation 60 is initially open and is tipped off after the gaseous medium is supplied to the interior of the envelope.

In addition, a metal ring 62 (FIG. 2) is interposed between hollow cylindrical container 22 and circular glass base 24. Metal ring 62 is circular in shape with a substantially uniform thickness. Its top edge is formed over to define a circular opening which receives the upper, reduced-diameter portion of base 24 defined by peripheral notch 64. Metal ring 62 is sealed to glass base 24 by conventional metal-to-glass sealing techniques to provide a gas-tight seal between the metal ring and glass base. The metal ring is subsequently welded to the interior of cylindrical container 22 by a seam weld to provide a gas-tight seal between the ring and container. The seam weld may be achieved by overlapping the spot welds produced by a laser type welder to form a continuous weld. Alternatively, TIG (tungsten inert gas) or electron beam welding techniques can be used in lieu of laser welding to provide the continuous weld.

Transparent window 26 is sealed to the inside of metallic container 22 over window opening 54. It is sealed to annular flange 56 inside the top end of the container 22 to provide a gas-tight seal between the window and container. Window 26 is generally circular in configuration. It extends outward to the interior cylindrical side wall of container 22 and upward into window opening 54 defined by flange 56. Preferably, it is composed of glass which is transparent to ultraviolet light.

In the fabrication of the metal envelope flashtube, insulating glass base 24 is pre-formed into its desired circular configuration with peripheral notch 64 on its upper surface, the central opening for receiving tubulation 60, and the plurality of openings with corresponding cone-shaped beads 58 on the lower surface of the base for receiving rod-like conductors 30, 32, 40, 42 and 48. The tubulation and conductors are inserted into the corresponding openings and sealed to the insulating glass base by conventional glass-to-metal sealing techniques, e.g., by firing the glass base, tubulation and conductors in a gas or electric oven. The glass material of the base and the metal of the tubulation and conductors are selected to have similar coefficients of expansion to provide matched glass-to-metal seals. The lower end of tubulation 60 is initially open.

After the tubulation and conductors are sealed in the openings provided in insulating glass base 24, metal ring 62 is placed at the periphery of the circular base. The top edge of ring 62 is received in peripheral notch 64 provided in base 24. Again, conventional glass-to-metal sealing techniques, e.g., firing in a gas or electric oven, can be used to seal metal ring 62 to insulating glass base 24.

Subsequently, cathode 34 and anode 36 are welded to the upper ends of conductors 30 and 32. If desired, as shown in FIGS. 2 and 3, conductor 30 can be bent toward conductor 32 to orient one corner of rectangular cathode 34 in the discharge path with the nose of anode 36. Probe-type electrodes 44 and 46 are welded to the upper ends of conductors 40 and 42 with the free ends of the electrodes in alignment with the discharge path between cathode 34 and anode 36.

Preferably, resistance welding is used to attach the cathode, anode and probe-type electrodes to the conductors. During the welding operation, $CO_2$ is flushed around the electrodes to prevent oxidation.

In addition, hollow metal body 22 is pre-formed as a thin-walled, generally cylindrical container with an open bottom end and flange 56 at its upper end which defines window opening 54. Metal container 22 is turned upside down and a disc-shaped wafer of transparent glass having a diameter slightly smaller than the inner diameter of container 22 is placed in the container in contact with flange 56. The container and glass wafer are heated in an R.F. oven to fuse the glass wafer to the interior of flange 56 to provide transparent glass window 26. As shown in FIG. 2, the glass material is sealed to annular flange 56 and a portion of the material extends into window opening 54. In addition, the glass material spreads outwardly at its periphery to completely cover flange 56 and assume the same diameter as the inner diameter of container 22.

To assemble the flashtube envelope, insulating base 24 is inserted into the open bottom end of container 22 to locate the electrodes within the container and to abut ring 62 against the inside of the container. A laser spot welder may be used to weld ring 62 to container 22. The container and base are rotated during the laser welding operation to overlap the weld spots produced by the laser welder to provide a gas-tight seam weld between the ring and container.

Alternatively, the welding of metal ring 62 to container 22 can be accomplished by TIG (tungsten inert gas) techniques in which an electric arc welder is used. The container and ring are rotated adjacent to a fixed arc welder which melts the metal of the container and ring to achieve a continuous weld. A sheath of inert gas is flushed over the container to prevent oxidation. To dissipate heat generated in the welding operation, metal container 22 is placed in contact with a heat sink, e.g., a chill block which surrounds the container. Flange 56 of the container readily conducts heat away from the area of glass window 26 to avoid cracking of the glass.

As a further alternative, electron beam welding may be employed to weld metal ring 62 to the container. The electron beam is applied to the container in the vicinity of ring 62, and the container and ring are rotated to achieve a continuous weld. Again, flange 56 of the container serves to rapidly conduct heat away from glass window 26 to prevent cracking of the glass.

Subsequently, the flashtube envelope is evacuated through the lower, open end of tubulation 60 and the flashtube is heated for the time necessary to clean the interior of the envelope and to out-gas the electrodes. Next, a gaseous medium, e.g., xenon, is supplied to the interior of the envelope through tubulation 60. The envelope is filled with xenon to a desired pressure, e.g., 3–4 atmospheres. The lower end of tubulation 60 is mechanically tipped off to cold weld the end closed and seal the interior of the envelope from the ambient atmosphere.

In the operation of the metal envelope flashtube, a potential difference is applied across cathode 34 and anode 36 which is insufficient to produce a discharge through the gaseous medium in the envelope. A trigger voltage is simultaneously applied to probe-type electrodes 44 and 46 via conductors 40 and 42, respectively, to break down the gas between cathode 34 and anode 36. Since the spacing between cathode 34 and probe-type electrode 44 is less than the spacing between anode 36 and probe-type electrode 46, the gas in the neighborhood of cathode 34 initially ionizes to permit a trigger streamer to form between the cathode and probe-type electrode 44. The ionization continues along the discharge path between probe-type electrodes 44 and 46 and between probe-type electrode 46 and anode 36 to completely form the trigger streamer. Upon completion of the streamer, the impedance between cathode 34 and anode 36 is sufficiently reduced to allow the main electrical discharge to occur.

If sparker assembly 50 is employed in the flashtube, the trigger pulse is also applied to the sparker assembly via conductor 48. The sparker assembly produces a discharge arc each time the flashtube is triggered to emit ultra violet photons which impinge on cathode 34 at the same time that the trigger pulse is applied to probe-type electrode 44. The photons from the arc produced by sparker assembly 50 impinging on cathode 34 release photo-electrons from the cathode which in conjunction with the electric field produced by the trigger pulse at probe-type electrode 44 initiate ionization of the gas between cathode 34 and trigger probe 44 and initiate the trigger streamer. Photons emitted by the arc produced by sparker assembly 50 may also impinge on the other tube elements to assist in ionizing the gas to complete the trigger streamer along the entire discharge path. A more detailed description of the structure and operation of the sparker assembly can be obtained by reference to U.S. Pat. Nos. 3,350,602 and 3,356,888 assigned to the same assignee as the present invention.

The electrical discharge in the gaseous medium between the cathode and anode produces a high intensity flash of light. Since the density of the gaseous medium in the metal envelope flashtube greatly exceeds the gas density of convention bulb-shaped flashtubes, the light output of the metal envelope flashtube is greatly enhanced in comparison with that of conventional glass bulb-shaped flashtubes.

The metal envelope of the flashtube advantageously allows the envelope to be grounded in the flashtube operation. The grounded metal envelope minimizes the possibility of accumulation of static charges on the envelope and thus avoids the problems of spurious electric fields associated with the glass flashtubes of the prior art. The elimination of spurious electric fields improves the stabilization of the flash-producing arc by ensuring an electrical discharge along the path between the cathode and anode established by the probe-type electrodes. The trigger streamer established upon application of the trigger pulse to the probe-type electrodes is confined to the desired discharge path. The absence of accumulated charges on the envelope precludes formation of the streamer in the wrong place. The absence of spurious electric fields also permits a lower trigger voltage to be employed to form the streamer. Further, the elimination of spurious fields also improves stability of operation at low repetition rates.

In addition, the grounded metal envelope provides an electrical shield which substantially shields the RFI produced by the flashtube during its operation. This eliminates the necessity of providing separate RFI shields for the glass flashtubes of the prior art.

Generally, it has been found that grounding the metal envelope significantly enhances the operating characteristics of the flashtube by achieving reliable operation at significantly lower source and trigger voltages than are possible with the prior art bulb-shaped flashtubes. The reasons for this unobvious result are not known at this time.

The metal envelope also advantageously allows the flashtube to dissipate heat more effectively than prior art devices. As a result, when used with an appropriate heat sink, the metal envelope flashtube is considerably more efficient in removal of heat generated in its operation than conventional glass bulb-shaped flashtubes. The cooling effect of the metal envelope on the interior of the flashtube allows the temperature and pressure of the gaseous medium in the flashtube to remain lower than in conventional glass bulb-shaped flashtubes. Consequently, the metal envelope, glass window, and the metal-to-glass seals between the conductors and base are subjected to less stress than in conventional flashtubes. The flange surrounding the transparent window of the metal envelope flashtube serves to readily conduct heat away from the window area to reduce the temperature and stress on the glass window.

The improved heat dissipation characteristics of the metal envelope bulb-shaped flashtube permit more power to be applied to the flashtube. Since the heat generated in operation of the metal envelope flashtube is dissipated more rapidly across the envelope than with conventional glass envelopes, the metal envelope flashtube can more readily withstand the increased power level. The prior art bulb-shaped flashtubes have been restricted to a maximum power limit of 15 watts. Typically, for saftey reasons, such flashtubes have been limited to average power imputs of only a few watts. However, the enhanced strength of the metal envelope flashtube and its improved heat dissipation characteristics permit operation at substantially higher powers. For example, flashtubes constructed according to the principles of the present invention have been safely operated at a power level of approximately 43 watts and have been operated at power levels up to approximately 88 watts without failure.

Since the metal envelope flashtube can be operated at substantially higher input powers, the diameters of the cathode and anode conductors 30 and 32 are made larger than the diameter of similar conductors used in conventional glass bulb-shaped type flashtubes. The larger conductors also make a slight contribution to heat dissipation in the operation of the flashtube. The sealing beads provided on the insulating base around the openings for the conductors provide electrical insulation to preclude electrical discharge between the conductors outside the flashtube envelope.

The metal envelope flashtube is particularly suitable for use in a light generating device employed in the curing of materials such as photo-initiated polymer resins. In such a device, the flashtube is mounted in an appropriate electrical socket for connecting its conductors to a power supply and trigger circuit to generate electrical discharges. The ultraviolet components of the light flashes result in curing of the material. The intense flashes of light generated by the flashtube allow the material to be rapidly cured. The ability to ground the flashtube envelope provides protection against inadvertent electrical shocks.

In a specific embodiment of the metal envelope flashtube, container 22 consists of stainless steel approximately 0.020 inch in thickness. The container is approximately 0.880 to 0.905 inch in height and has an outer diameter of approximately 1.130 to 1.150 inch. Window opening 54 is centrally located at the top end of the container and is approximately 0.557 to 0.567 inch in diameter.

Transparent glass window 26 is composed of soda lime glass (e.g. Corning code 0080) capable of transmitting ultraviolet light. It is approximately 0.062 inch in thickness in the area of window opening 54. Insulating base 24 is composed of hard glass (e.g. Corning code 7052). Its overall height including beads 58 is 0.287 inch. Its upper portion of reduced diameter provided by the peripheral notch is approximately 1.008 inch in diameter and 0.062 inch in height. The height of each bead 58 is approximately 0.100 inch and its tapered surface is inclined at an angle of approximately 45° to the lower surface of glass base 24. The upper surface of the glass base is slightly roughened to provide for diffuse reflection of flashes of light generated by electrical discharges between the electrodes.

Conductors 30, 32, 40, 42 and 48 and tube 56 consist of an iron-nickel alloy known as Kovar. Conductors 30 and 32 are approximately 1 9/32 inch in length and approximately 0.080 inch in diameter. Conductors 40, 42, and 48 are also approximately 1 9/32 inch in length and approximately 0.040 inch in diameter. The conductors are arranged in a circular configuration having a diameter of approximately 0.576 to 0.580 inch.

In addition, metal ring 62 is composed of Kovar and is approximately 0.021 inch in thickness and 0.250 inch in height. It has an outer diameter of approximately 1.094 to 1.096 inch, and its top edge is formed over to define a circular opening of approximately 1.015 to 1.017 inch in diameter. Cathode 34 and anode 36 are sintered tungsten electrodes, while probe-type electrodes 44 and 46 are pure tungsten.

The flashtube of the present invention has been satisfactorily operated at a power input of 43 watts with a capacitance of 2 microfarads charged to an applied voltage of 600 volts connected across the anode and cathode and a trigger pulse frequency of 120 Hz. It has been observed that the flashtube operates at a temperature of approximately 38° C when used in contact with a heat sink.

In addition, the flashtube has been operated at the conditions specified in the following table. As above, the flashtube had a capacitance of 2 microfarads connected between the anode and cathode, and a trigger pulse frequency of 120 Hz was used. The temperature of the metal envelope was observed without a heat sink. In each case, the life expectancy was determined by extrapolating data acquired from conventional life tests.

| Power (Watts) | Voltage (Volts) | Temperature | Life Expectancy (Number of Flashes) |
|---|---|---|---|
| 38.4 | 800 V | 170° C | 250–300 × $10^6$ |
| 46.4 | 850 V | 185° C | 250–300 × $10^6$ |
| 49.8 | 900 V | 195° C | 250–300 × $10^6$ |
| 72 | 1100 V | 225° C | 200–250 × $10^6$ |
| 84 | 1180 V | 280° C | 150–200 × $10^6$ |

In each instance, a trigger pulse having a peak open-circuit voltage of 6000 volts has been used. However, during operation of the flashtube the ionized trigger streamer forms and the arc discharge occurs when the trigger voltage reaches approximately 2500 volts, the trigger circuit thereafter being effectively short-circuited until de-ionization of the gaseous medium in the flashtube occurs.

There are some applications where a window in the side wall, rather than the end, of the metal envelope is desirable. An embodiment to achieve this is illustrated conceptually in FIGS. 7–11 inclusive.

Referring to FIGS. 7 and 8, a bulb-shaped metal envelope flashtube, generally 70, constructed according to the present invention, includes a gas-filled envelope comprising a hollow metallic body 72, an insulating base 74, and a transparent side window 76. A plurality of conductors extend through insulating base 74 into the interior of the container and support spaced electrodes for electrical discharge through a gaseous medium confined in the envelope. As shown in FIG. 10, for example, the conductors may be arranged in a configuration suitable to be received in an appropriate electrical socket or female connector (not shown).

As shown in FIGS. 8 and 9, a first pair of rod-like conductors 80 and 82, with their inner ends 81 and 83 bent at 90° angles, extend through insulating base 74 at diametrically opposed positions on the base. Conductor 80 may serve as a ground conductor. A rectangular electrode 84, which serves as the cathode of the flashtube, is mounted at inner end 81 of conductor 80. A generally cylindrical electrode 86 provided with a cone-shaped nose 88, which serves as the anode of the flashtube, is mounted at inner end 83 of conductor 82. Cathode 84 and anode 86 may be located in the vertical configuration shown in opposed positions substantially along the axis 90 of the flashtube to define an axial electrical discharge path indicated by dashed line 92 (FIG. 8).

In addition, a plurality of conductors extend through the insulating base to support trigger electrodes adjacent to the electrical discharge path between the anode and cathode. For example, as shown in FIGS. 8 and 9, a second pair of rod-like conductors 94 and 96 extend through insulating base 74. The second pair of conductors 94 and 96 is smaller in diameter than the first pair of conductors 80 and 82. A first probe-type trigger electrode 98 is mounted at the upper end of conductor 94. Its free end 99 extends to a position adjacent to cathode 84 in discharge path 92 between the cathode 84 and anode 86. Similarly, a second probe-type electrode 100 is mounted at the upper end of the conductor 96. Its free end 101 extends to a position adjacent to anode 86 in discharge path 92 between anode 86 and cathode 84. If desired, additional conductors and probe-type trigger electrodes can be provided adjacent to discharge path 92 as illustrated in U.S. Pat. Nos. 2,977,508, 3,350,602 and 3,356,888 assigned to the same assignee as the present invention.

As shown in FIG. 3, a sparker assembly 50 could be utilized in the embodiment of FIGS. 7–11, but is not shown to facilitate the description.

Referring to FIG. 8, anode 86 is welded to the inner end 83 of conductor 82 with its cylindrical body and nose 88 axially oriented along the axis 90 of the flashtube. Cathode 84 is welded to the inner end 81 of ground conductor 80 in an offset position, tilting the rectangular front face of cathode 84 away from nose 88 of the anode. In addition, cathode 84 is turned at a slight angle on inner end 81 relative to the axis of the flashtube. As a result, one corner of the cathode 84 is oriented in discharge path 92 between the cathode and anode. Preferably, the distance between cathode 84 and free end 99 of probe-type electrode 98 is less than the distance between anode 86 and free end 101 of probe-type electrode 100.

In accordance with the invention, the flashtube envelope generally comprises a hollow conductive body having first and second openings. As shown in FIG. 8, the embodiment of conductive envelope body 72 is embodied as a hollow cylindrical container of metal including an open bottom end, closed upper end and a rectangular window opening 110 formed in the side of the container.

Insulating base 74 (FIGS. 8 and 10) is generally circular in configuration and preferably composed of glass. The base is provided with a plurality of openings of suitable size for receiving conductors 80, 82, 94 and 96. The openings are preferably arranged in a circular configuration and spaced apart by approximately 90°.

As shown in FIG. 10, base 74 includes a plurality of glass beads 102, i.e. cone-shaped areas of glass, on its bottom surface around each conductor opening. The conductors are sealed in the corresponding openings preferably by conventional matched glass-to-metal seals. A peripheral notch 104 is formed in the top surface of the base to define an upper portion of slightly reduced diameter.

Insulating base 74 is also provided with a central opening for receiving a tubulation 106. The tubulation is composed of metal and sealed to the glass base by conventional metal-glass sealing techniques. The purpose of the tubulation is to provide an outlet for removing impurities from the interior of the flashtube after assembly of the envelope and an inlet for supplying the desired gaseous medium to the flashtube. The lower end of tubulation 106 is initially open and is tipped off after the gaseous medium is supplied to the interior of the envelope.

In addition, a metal ring 108 (FIG. 8) is interposed between hollow cylindrical container 72 and circular glass base 74. Metal ring 108 is circular in shape with a substantially uniform thickness. Its top edge is formed over to define a circular opening which receives the upper, reduced-diameter portion of base 74 defined by peripheral notch 104. Metal ring 108 is sealed to glass base 74 by conventional metal-to-glass sealing techniques to provide a gas-tight seal between the metal ring and glass base. The metal ring is subsequently welded to the interior of cylindrical container 72 by a seam weld as hereinbefore described to provide a gas-tight seal between the ring and container.

Transparent window 76 is sealed to the inside of the metallic container 72 over rectangular window opening 110. It is sealed to the inner surface of container 72 between ribs 112 and 114 to provide a gas-tight seal between the window and container. Window 76 is generally rectangular in configuration. It extends outward to ribs 112 and 114 inside container 72 and outward into window opening 110. Preferably, it is composed of glass which is transparent to ultraviolet light.

In the fabrication of this embodiment of the metal envelope flashtube, insulating glass base 74 is preformed into its desired circular configuration with peripheral notch 104 on its upper surface, the central opening for receiving tubulation 106, and the plurality of openings with corresponding cone-shaped beads 102 on the lower surface of the base for receiving rod-like conductors 80, 82, 94 and 96. The tubulation and conductors are inserted into the corresponding openings and sealed to the insulating glass base by conventional glass-to-metal sealing techniques, e.g., by firing the glass base, tubulation and conductors in a gas or electric oven. The glass material of the base and the metal of the tubulation and conductors are selected to have similar coefficients of expansion to provide matched glass-to-metal seals. The lower end of tubulation 106 is initially open.

After the tubulation and conductors are sealed in the openings provided in insulating glass base 74, metal ring 108 is placed at the periphery of the circular base. The top edge of ring 108 is received in peripheral notch 104 provided in base 74. Again, conventional glass-to-metal sealing techniques, e.g., firing in a gas or electric oven, can be used to seal metal ring 108 to insulating glass base 74.

Subsequently, cathode 84 and anode 86 are welded to the inner ends of conductors 80 and 82. If desired, as shown in FIG. 8, one corner of rectangular cathode 84 is oriented in discharge path 92 with nose 88 of anode 86. Probe-type electrodes 44 and 46 are welded to the upper ends of conductors 98 and 100 with their free ends 99 and 101 in alignment with discharge path 92.

Preferably, resistance welding is used to attach the cathode, anode and probe-type electrodes to the conductors. During the welding operations, $CO_2$ is flushed around the electrodes to prevent oxidation.

Hollow metal body 72 may be made by conventional techniques such as, for example, first cutting rectangular window opening 110 in a rectangular sheet of stainless steel approximately 0.020 inch in thickness. Ribs 112 and 114 of stainless steel of the same thickness then may be welded around opening 110. The sheet then can be formed into a cylinder and welded at seam 116, FIG. 7. Then lid 118 can be seam welded to the cylinder. Metal container 72 is turned on its side and a curved rectangular-shaped wafer of transparent glass having dimensions slightly smaller than the curved rectangle formed by ribs 112 and 114 is placed in the container in contact with its inner surface within the curved rectangle. The container and glass wafer are heated in an R. F. oven to fuse the glass wafer to the interior of container 72 to provide transparent glass window 76. As shown in FIG. 8, the glass material is sealed to the inner surface within the ribs and a portion of the material extends into window opening 110. In addition, the glass material spreads outwardly at its periphery to ribs 112 and 114.

To assemble the flashtube envelope, insulating base 74 is inserted into the open bottom end of container 72 to locate the electrodes within the container and to abut ring 108 against the inside of the container. Again, a laser spot welder may be used to weld ring 108 to container 72. The container and base are rotated during the laser welding operation to overlap the weld spots produced by the laser welder to provide a gas-tight seam weld between the ring and container.

Alternatively, the welding of metal ring 108 to container 72 can be accomplished by TIG (tungsten inert gas) techniques in which an electric arc welder is used or by electron beam welding, as described hereinabove.

Subsequently, the flashtube envelope is evacuated through the lower, open end of tubulation 60 and the flashtube is heated for the time necessary to clean the interior of the envelope and to out-gas the electrodes. Next, a gaseous medium, e.g., xenon, is supplied to the interior of the envelope through tubulation 60. The envelope is filled with xenon to a desired pressure, e.g., 3–4 atmospheres. The lower end of tubulation 60 is mechanically tipped off to cold weld the end closed and seal the interior of the envelope from the ambient atmosphere.

The operation of the alternative embodiment (FIGS. 7–11) of the metal envelope flashtube with the side window opening is similar to the operation previously described in connection with the embodiment of the metal envelope flashtube shown in FIGS. 1–6. A potential difference is applied across cathode 84 and anode 86 which is insufficient to produce a discharge through the gaseous medium in the envelope. A trigger voltage is simultaneously applied to probe-type electrodes 98 and 100 via conductors 94 and 96, respectively, to break down the gas between cathode 84 and anode 86. Since the spacing between cathode 84 and free end 99 of probe-type electrode 98 is less than the spacing between anode 86 and free end 101 of probe-type electrode 100, the gas in the neighborhood of cathode 84 initially ionizes to permit a trigger streamer to form between the cathode and probe-type electrode 98. The ionization continues along discharge path 92 between probe-type electrodes 98 and 100 and between probe-type electrode 100 and anode 86 to completely form the trigger streamer. Upon completion of the streamer, the impedence between cathode 84 and anode 86 is sufficiently reduced to allow the main electrical discharge to occur.

If a sparker assembly is employed in the flashtube of FIGS. 7–11, the operation is substantially identical to the operation described above in connection with the flashtube of FIGS. 1–6. The trigger pulse is applied to the sparker assembly via a suitable conductor (not shown). The sparker assembly produces a discharge arc each time the flashtube is triggered to emit ultraviolet photons which impinge on cathode 84 at the same time that the trigger pulse is applied to probe-type electrode 98. The photons from the arc produced by the sparker assembly inpinging on cathode 84 release photo-electrons from the cathode which in conjunction with the electric field produced by the trigger pulse at probe-type electrode 98 initiate ionization of the gas between cathode 84 and trigger probe 98 and initiate the trigger streamer. Photons emitted by the arc produced by the sparker assembly may also impinge on the other tube elements to assist in ionizing the gas to complete the trigger streamer along the entire discharge path. As mentioned above, a more detailed description of the structure and operation of the sparker assembly can be obtained by reference to U.S. Pat. Nos. 3,350,602 and 3,356,888 assigned to the same assignee as the present invention.

The present invention achieves a flashtube with a metallic envelope of increased strength, to permit the flashtube to be filled with more gas at higher density and pressure than previously possible to enhance the intensity of the light flashes generated by the flashtube. The flashtube envelope can be grounded to eliminate charge accumulation on the envelope and the associated spurious electric fields, to lower the required trigger and supply voltages and thus to enhance the reliability of operation of the flashtube. The invention also provides a flashtube envelope which can withstand greater mechanical shock than glass envelopes. In addition, the metal envelope readily dissipates heat to allow the flashtube to be operated at lower temperatures, to reduce the stresses on the envelope and seals and to avoid the problem of cracking associated with envelopes consisting entirely of glass.

By fabrication of the flashtube envelope with a pre-formed metal container and transparent window assembly and a pre-formed insulating base and electrode assembly, the invention achieves a flashtube in which the electrodes are in accurate alignment. The heat dissipating features of the metal envelope also contribute to the accuracy of alignment of the electrodes by reducing the likelihood of changes in positions of the electrodes when heat is applied during fabrication of the flashtube.

The invention in its broader aspects is not limited to the specific details shown and described, and modifications may be made in the details of the metal envelope flashtube without departing from the principles of the invention.

What is claimed is:

1. A gaseous-discharge device of the type comprising a gas-filled envelope which contains spaced electrodes for electrical discharge therebetween to produce a flash of light, wherein said envelope comprises:

a hollow conductive body having first and second openings;

an insulating base sealed in said first opening of said conductive body and including means to support the electrodes within said conductive body; and a transparent window sealed to the inside of said conductive body at and over said second opening for transmitting the flash of light therethrough upon electrical discharge between the electrodes.

2. A gaseous-discharge device of the type comprising a gas-filled envelope which contains spaced electrodes for electrical discharge therebetween to produce a flash of light, wherein said envelope comprises:

a hollow cylindrical body of metal including a first open end and a second partially closed end provided with a window opening;

an insulating base sealed in said open end of said body and including means to support the electrodes within said body; and a transparent window sealed to the interior of said body at said partially closed end over said window opening for transmitting the flash of light therethrough open electrical discharge between the electrodes.

3. The gaseous-discharge device of claim 2, which includes:

a plurality of conductors extending through said insulating base for supporting the electrodes within said envelope.

4. A gaseous-discharge device of the type comprising a gas-filled envelope which contains an anode and a cathode spaced from the anode for generating a flash of light upon electrical discharge therebetween, wherein said envelope comprises:

a hollow cylindrical container of conductive material, said container including an open bottom end and an inwardly extending annular flange at its top end which defines a window opening in said container;

a circular glass base sealed in said open bottom end of said container and including means to support the anode and cathode within said container; and a circular, transparent glass window sealed to said annular flange inside said top end of said container for transmitting the flash of light therethrough upon electrical discharge between the anode and cathode.

5. The gaseous-discharge device of claim 4, wherein said circular, transparent glass window is capable of transmitting ultraviolet light.

6. The gaseous-discharge device of claim 4, which includes:

a pair of conductors extending through said circular glass base for supporting the anode and cathode within said container.

7. The gaseous-discharge device of claim 4, which includes:

a tubulation extending through said circular glass base to provide an inlet for supplying gas to the inteior of the gaseous-discharge device, said tubulation having an initially open end to be sealed after gas is supplied to the interior of the envelope.

8. The gaseous-discharge device of claim 4, wherein:

said hollow cylindrical container consists of stainless steel; and said circular transparent glass window consists of soda lime glass.

9. A gaseous-discharge device, comprising:

an insulating base;

a plurality of conductors extending through said base;

a plurality of electrodes mounted on said conductors in a spaced configuration;

only one envelope sealed to said base to contain said electrodes, said envelope being made of metal and including a window opening; and a transparent window sealed to the inside of said envelope at and over said opening for transmitting light therethrough upon an electrical discharge between the electrodes.

10. The gaseous-discharge device of claim 9, wherein said plurality of electrodes include:

an anode;

a cathode spaced from said anode to provide a discharge path therebetween; and a plurality of probe-type trigger electrodes successively disposed at spaced intervals in the discharge path between said anode and cathode.

11. The gaseous-discharge device of claim 10, which includes:

a sparker assembly mounted on one of said conductors for producing a discharge to emit light onto said cathode.

12. The gaseous-discharge device of claim 9, wherein:

said metal envelope comprises a hollow cylindrical container including a first open end and a second partially closed end provided with an inwardly extending annular flange to define said window opening;

said insulating base being sealed within said first open end of said container; and said transparent window being sealed to said annular flange inside said second partially closed end of said container.

13. The gaseous-discharge device of claim 12, wherein said transparent window comprises:

a circular glass window having substantially the same diameter as the interior of said container to completely cover said annular flange.

14. The gaseous-discharge device of claim 12, wherein:

said insulating base is substantially circular in configuration and provided with a plurality of openings extending therethrough; and said conductors are sealed in said openings provided in said insulating base.

15. The gaseous-discharge device of claim 14, which includes:

a tubulation extending through said insulating base to provide an inlet for supplying gas to the interior of the gaseous-discharge device, said tubulation having an initially open end to be sealed after gas is supplied to the interior of the envelope.

16. The gaseous-discharge device of claim 9, wherein:

said metal envelope comprises a hollow cylindrical container including a first open end and a second closed end;

said window opening being formed in the side of said container;

said insulating base being sealed within said first open end of said container; and said transparent window being sealed to the inside of said container over said window opening in the side of said container.

17. The gaseous-discharge device of claim 16, which includes:

a plurality of ribs formed on the inside of said container and surrounding said window opening;

said transparent window extending along the inside of said container to said ribs.

18. The gaseous-discharge device of claim 17, wherein:

said window opening is substantially rectangular in configuration with said ribs arranged in a rectangular configuration about said opening; and said transparent window is a substantially rectangular glass window with its edges extending outwardly to said ribs.

19. The gaseous-discharge device of claim 16, wherein:

said insulating base is substantially circular in configuration and provided with a plurality of openings extending therethrough; and said conductors are sealed in said openings provided in said insulting base.

20. The gaseous-discharge device of claim 16, which includes:

a tubulation extending through said insulating base to provide an inlet for supplying gas to the interior of the gaseous-discharge device, said tubulation having an initially open end to be sealed after gas is supplied to the interior of the envelope.

* * * * *